US005581339A

United States Patent [19]

Jamzadeh et al.

[11] Patent Number: 5,581,339

[45] Date of Patent: Dec. 3, 1996

[54] METHOD OF FORMING DUPLEX TONER IMAGES

[75] Inventors: Feraydoon S. Jamzadeh, Fairport; James R. Flick; David J. Reed, both of Rochester, all of N.Y.

[73] Assignee: Eastman Kodak Company, Rochester, N.Y.

[21] Appl. No.: 281,282

[22] Filed: Jul. 27, 1994

[51] Int. Cl.[6] ..... G03G 15/20

[52] U.S. Cl. ..... 355/282; 347/232; 355/208; 355/319; 355/327; 430/97

[58] Field of Search ..... 355/282, 285, 355/290, 295, 208, 327, 319, 326 R, 77; 219/216, 469–471; 430/97, 98; 432/60; 118/60; 358/505, 474, 487; 347/115, 232

[56] References Cited

U.S. PATENT DOCUMENTS 5,051,780 9/1991 Stelter et al. ..... 219/216 X
5,450,183 9/1995 O'Leary ..... 355/285
5,459,819 10/1995 Watkins et al. ..... 395/117

FOREIGN PATENT DOCUMENTS 2-203342 8/1990 Japan ..... 355/285
4-344682 12/1992 Japan ..... 355/295
6-202520 7/1994 Japan ..... 355/285

*Primary Examiner*—Shuk Yin Lee
*Attorney, Agent, or Firm*—Leonard W. Treash

[57] ABSTRACT

A method of forming duplex color images on a receiving sheet passes the receiving sheet through a fuser twice for the first image and once for the second image. The process includes the step of determining which of the toner images should have a higher gloss and forming that toner image first so that it receives the greatest fusing energy. Preferably, the determining step is accomplished by determining which image receives more photographic content.

11 Claims, 2 Drawing Sheets

METHOD OF FORMING DUPLEX TONER IMAGES

This invention relates to the formation of duplex images. It is particularly useful in the formation of duplex color images in an apparatus or system in which a first color image is fused to a receiving sheet before the second color image is transferred to the receiving sheet.

One approach to forming duplex toner images is to form a toner image on a receiving sheet and fix it by passing it through a heated roller fuser or similar apparatus. The sheet is then returned to the image forming means by the apparatus or by hand and an image is formed on the opposite side of the sheet. The sheet can pass through the heated roller fuser again, providing duplex output. Even in doing ordinary black and white copying, the industry is aware that the first pass through the fuser adversely affects the receiving sheet, in some instances, causing the second image to be more difficult to transfer.

Most high quality color copiers and printers are not used for duplex extensively. This is partly due to less demand for duplex color and partly due to the fact that the variance in fusing has much greater effect on the color image than on a black and white page.

U.S. Pat. No. 5,459,819, Watkins et al, issued Oct. 17, 1995, discloses the customization of greeting cards using a Kodak ColorEdge 1550 Plus color copier to customize color greeting cards and other items that necessarily would be duplexed. In addition to the problems with fusing color toners, the greeting cards are generally made out of much stiffer stock than normally used on color electrophotographic apparatus. The sheet absorbs heat from the fuser when first contacting it, making quality fusing more difficult.

The above patent application discloses an operator at a workstation composing each image side of a sheet to be turned into a greeting card. The card is then printed with a copier of the type identified, only slightly modified. The system at the workstation would lead the operator through picking out the size of greeting card (including picking where a single sheet should be folded), the background for each side, location of the message which is typed in by the operator, and then the location of the operator's preference of both graphics pulled from memory and photographs that are scanned in to the workstation memory.

Alternatively to electronic composing, the color scanner presently provided on the apparatus referred to can be used to image both sides. In this instance, each side is prepared by hand, using cutting and pasting techniques, including the background, the photographic portion, the message portion and whatever else the operator wishes to put in the customized product.

For purposes herein, images on opposite sides of the sheet making up the greeting card will usually be referred to as holding first and second images, respectively, even though the receiving sheet may ultimately be folded and a single image take up more than one page in the final product.

SUMMARY OF THE INVENTION

Utilizing apparatus in which the first toner image is fused before the second toner image is formed on a receiving sheet creates differential fusing between the two duplex images. When the two duplex images are relatively high density color images, their gloss is quite noticeable and an important aspect of their reproduction. The gloss is a function of the extent of fusing. Thus, in this particular process, one image has a tendency to be glossier than the other. We have found that this aspect can not only be controlled but managed to advantage.

It is, thus, an object of the invention to improve on a process of forming duplex images, which process includes the steps of forming a first color toner image on a first side of a receiving sheet, passing the first toner image through a fuser, forming a second toner image on a second side of the receiving sheet and passing both toner images through a fuser.

This and other objects are accomplished by determining which image should have the greatest gloss and forming that image on the first side of the receiving sheet.

According to a preferred embodiment, the invention can be accomplished by the operator determining which of the toner images has the most photographic content (preferably prompted by an OCP) and making that image first so that it passes through the fuser twice and receives the greatest gloss.

According to another preferred embodiment, the determination step can be done automatically or by default with set up electronics for the process determining which image has the most content received from a scanner or which image has the most photographic content, or another similar priority approach to determine which side should have the most gloss.

Preferred embodiments of the invention have the advantage of providing the customer with not only customized images from a content standpoint, but also customized as to gloss. It is not uncommon for a preference for one side to be more glossy than the other and the combination of more gloss on one side and less on the other actually provides a preferred product. In other instances, the gloss on one side is less important than the other and, therefore, it is important that the side most dependent upon gloss, usually the side having the photographic input, be formed first.

According to another aspect of the invention, higher gloss is also likely in the portion of an image entering the fusing nip first. The most photographic content or densest portion of an image is determined by the operator or by image analysis. The image formation step is controlled to assure that the end of the sheet preferring the most gloss is fed first to the fuser. This can be done entirely by hand if the image is scanned in one step. Alternatively, the image can be electronically rotated to provide this advantage.

DETAILED DESCRIPTION OF THE INVENTION

Figure 1:
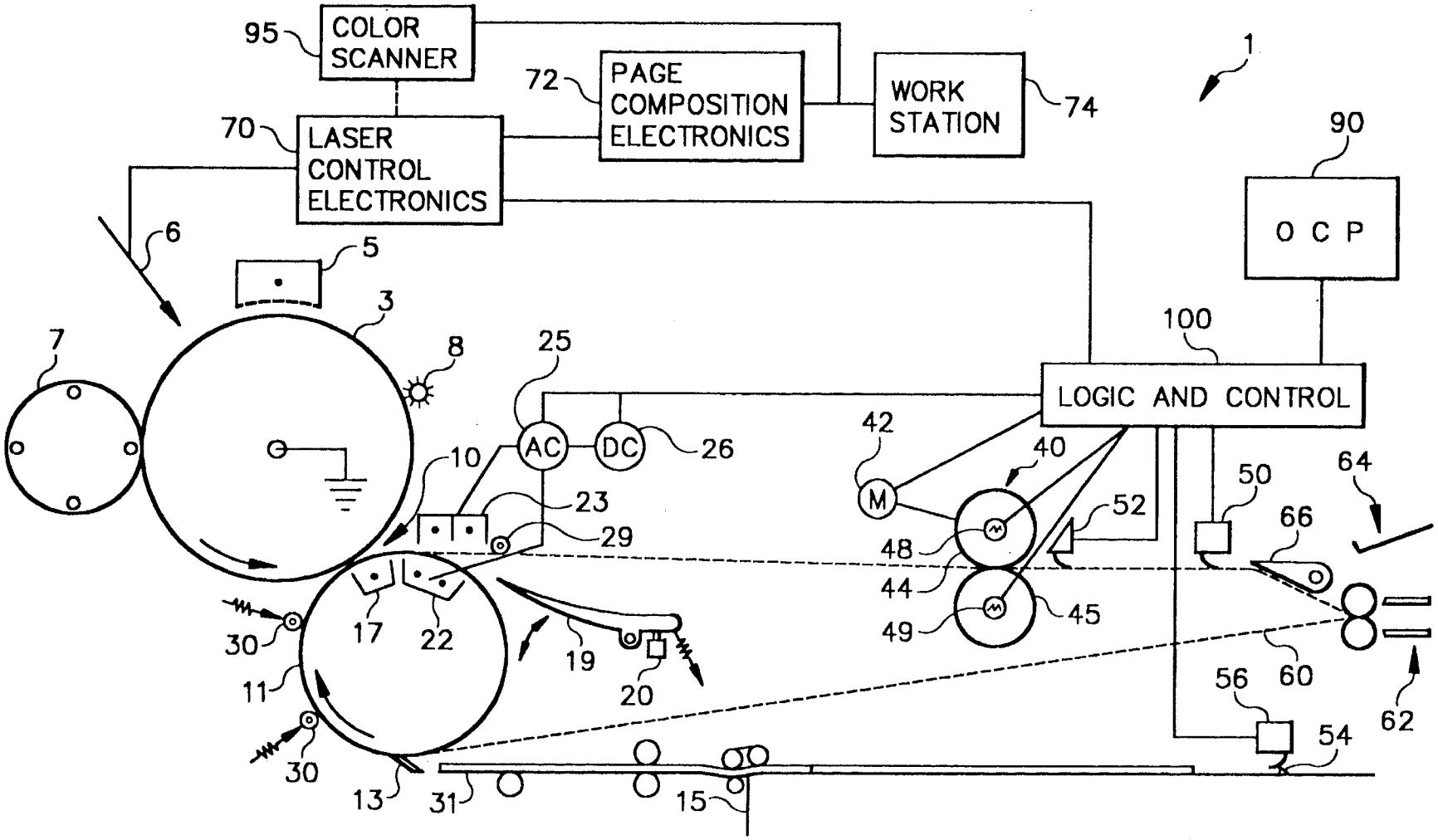
FIG. 1 is a schematic side view of an image forming apparatus.

Referring to FIG. 1, an image forming apparatus 1 includes an image member, for example, a photoconductive drum 3, on which toner images are formed conventionally. More specifically, the surface of drum 3 is uniformly charged by a charger 5 and imagewise exposed by exposing means, for example, a laser 6 to create a series of electrostatic images. Each of the electrostatic images is toned by the application of a different colored toner using a toning device 7 which contains four toning stations indexible through toning relation with image member 3.

At the same time, a receiving sheet 31 is fed from a receiving sheet supply 15 to the periphery of a transfer member 11. Transfer member 11 is shown as a drum, but could also be an endless belt, both of which are well known in the art for this application.

The leading edge of the receiving sheet 31 is gripped by a suitable holding means, for example, gripping fingers 13. A vacuum or electrostatics could also be used. As both the transfer drum 11 and the image member 3 are moved through a transfer nip at position 10, an electric field created by a transfer corona 17 or other field generating means transfers one of the toner images to the receiving sheet. As transfer member 11 is continually rotated, the series of different color toner images are transferred in registration to the receiving sheet to create a multicolor image on the sheet. After the desired number of transfers, the receiving sheet is separated from the transfer member 11 by a pivotable skive 19 which is moved into a position against transfer member 11 by a solenoid 20. Image member 3 is continually cleaned by a cleaning device 8 so that the process is continuous.

The receiving sheet 31 with the toner image on one side is now fed to a fuser 40 where a pair of fusing members 44 and 45, for example, conventional rollers internally heated by heaters 48 and 49, apply both pressure and heat to the image to at least partially fix it to the receiving sheet.

The receiving sheet can then be deposited in an output hopper 64. Alternatively, the receiving sheet is fed through a duplex path 60 which includes a deflector 66 and an inverter 62 back to the transfer member 11 to present the opposite side for receipt of a series of toner images, creating a second multicolor toner image on the reverse, second side of the receiving sheet. The sheet is again separated using separation skive 19 and fed again through the fuser 40 and into the output hopper 64.

Except for the automatic duplex mode of operation, the above very generally describes several different color image forming apparatus in commercial use today, for example, the Kodak ColorEdge 1550 Plus color copier. Duplex operation can be manually accomplished with these apparatus without the use of an internal duplex path.

U.S. Pat. No. 5,459,819 to Watkins et al, referred to above, describes a system for customized printing of a variety of articles with images obtained from a variety of different sources. In that system a photographic picture can be scanned and combined with graphics already in memory or composed on a screen and a typed in message to form a combined image using a printer also comparable to the color copier identified above. One of the applications suggested for this system is the formation of customized greeting cards in which a portion of an image can come from the scanning of a photograph, another portion can come from suitable background or other graphics stored in memory particularly suitable to greeting cards, and still another portion can be typed in (or graphics composed) at a workstation. This patent application is hereby incorporated by reference herein.

In adapting an electrophotographic printer to the greeting card application and other applications comparable to that, we have made a number of improvements in known apparatus. Greeting card stock is typically much stiffer than the normal range of receiving sheet usable in a typical color copier or printer. For example, it may be as stiff as 60 pound paper. Referring to FIG. 1, this poses its greatest problem in wrapping the receiving sheet around a relatively small transfer member, such as drum 11. It also affects other aspect of movement of the receiving sheet and fusing of the images.

Figure 2:
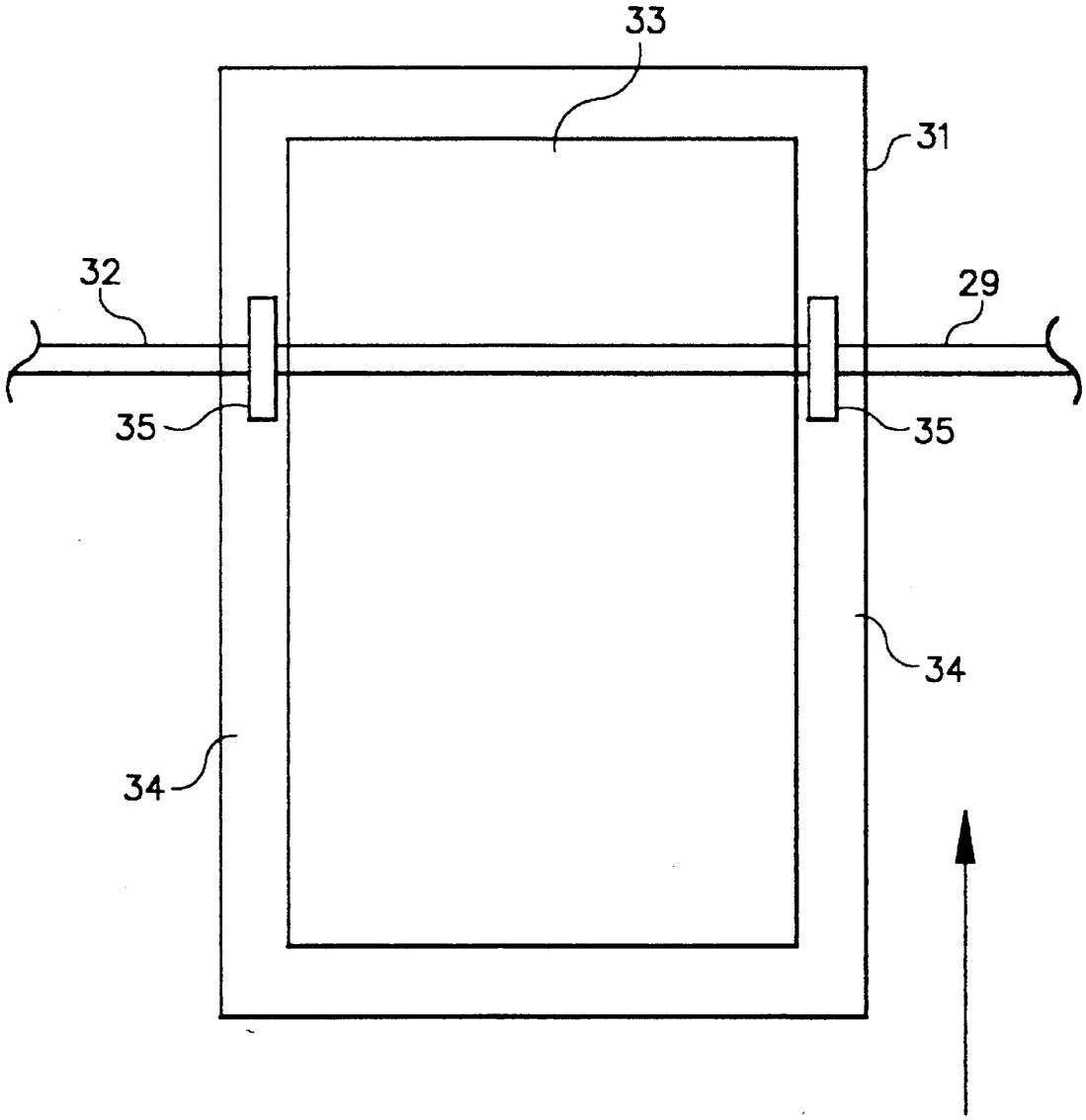
FIG. 2 is a top view of an image bearing receiving sheet and a receiving sheet engaging device.

Referring to FIG. 1, control of a stiff receiving sheet is assisted by first and second sheet engaging devices 29 and 30. Referring to FIG. 2, sheet engaging devices 29 and 30 (FIG. 1) preferably include a shaft 32 carrying a pair of rollers 35 which engage the toner side of the sheet in margins 34 designed to permit such engagement without adverse affect on a loose toner image. More specifically, a proposed toner image 33 is sized to fit on a receiving sheet 31 with significant margins 34 at each intrack side. Thus, if the receiving sheet is moved in the intrack direction of the arrow in FIG. 2, the rollers 35 can engage the toner side of the sheet in the margins 34 (generally parallel to the intrack direction) without disturbing toner image 33 which has not yet been fixed.

First sheet engaging device 29 is positioned just downstream of a set of corona chargers 23 (whose function will be described below). When a normal stiffness receiving sheet is separated by separation skive 19 from transfer member 11, it substantially follows the path of the upper surface of skive 19 toward fuser 40 because it is peeled off transfer member 11. However, a stiff receiving sheet has a tendency when separated by skive 19 to rotate upward toward corona charger 23. Any contact with charger 23 can disturb the image. Accordingly, first sheet engaging device 29 is positioned to intercept the leading portion of a stiff receiving sheet and prevent it from engaging charger 23. Because of the configuration of the image on the sheet providing margins 34, engaging device 29 does not affect the image. Engaging device 29 need not have a pair of rollers but could be stationary, non-rotatable guide pieces that are positioned to also engage margins 34.

It is important that the receiving sheet be firmly held to transfer member 11 for effective transfer by corona 17. Second sheet engaging devices 30 are positioned upstream of transfer corona 17 to urge the receiving sheet against transfer member 11 as it approaches the transfer area. Unlike the first sheet engaging device 29, the second sheet engaging device 30 is spring urged into contact with the transfer member.

It will be seen by someone skilled in the art that this principle could be applied in other places in the paper path of a stiff receiving sheet (or of a very flexible sheet). It should also be noted that it is known to use an endless belt for a transfer member, which endless belt generally traverses a path having sharper bends than does a transfer drum. A sheet engaging device such as device 30 is particularly useful in holding a stiff sheet to such a belt transfer member at its more curved turns.

Corona devices 22 and 23 are positioned to reduce electrostatic attraction of the receiving sheet to the transfer member 11 when a normal stiffness receiving sheet is used. With a normal, relatively flexible receiving sheet, separation of the sheet from the transfer member surface is difficult because of the strong electrostatic attraction between the sheet and the surface. An AC source 25 and a DC source 26 are used to essentially ground the two surfaces so that separation is easier.

However, when a stiff sheet is used, any immediate separation by the separation skive 19 is assisted by the beam strength of the sheet and the sheet has the tendency mentioned above of flapping up into the charger 23. At the trailing end of the sheet, separation can extend back into the transfer nip. It, thus, becomes desirable to attempt to hold the sheet to the transfer member rather than encourage its release. To effect this during the separation period, the AC corona is eliminated and a DC potential of the same polarity as the transfer corona 17 and of polarity opposite that of the toner image is applied by both chargers 22 and 23.

A logic and control 100 is programmed to provide this adjustment between the two conditions of the chargers 22 and 23.

It is known in the an to adjust conditions in an apparatus in response to code sensing on a cartridge. Paper supply 15 can be loaded by cartridge, with a machine readable coding 54 indicative of the stiffness of the receiving sheets in the cartridge. Coding 54 actuates a sensor 56 which signals logic and control 100 that stiff paper is in paper supply 15. Logic and control 100 then removes the AC voltage from the chargers 22 and 23 during separation of the sheet from transfer member 11 and inverts the polarity of the DC voltage applied by these chargers.

As described above, fuser 40 includes a first fusing member 44 which contacts the toner image to be fused and a second fusing member 45 which forms a heated pressure nip with the first fusing member 44. Both members are, in fact, rollers which are internally heated by a heating means 48 and 49. They are driven by a conventional motor 42 which has at least two speeds. Typically, a two speed motor is used in such fuser so that the fuser can be slowed for fusing transparency stock where more heat is necessary.

A heavier weight receiving sheet coming from transfer member 11 reduces the temperature in the nip upon contact with the rollers substantially more than a normal sheet of paper would reduce it. This effect is pronounced in paper receiving sheets in excess of 40 pound bond weight (150 grams per square meter), especially 60 pound (225 grams per square meter) stock or thicker. Typically, the reduction in temperature sends a signal to the logic and control 100 to apply heat through heating means 48 and 49 according to a program adapted to the particular fuser 40 being used. Using sensor 56, the amount of heat added and temperature set points can be adjusted for the heavier stock. However, there is a lag in the recovery that is quite substantial with a thick receiving sheet. In high gloss applications, preferable for color imaging, a substantial change in total heat added to the image shows up as a variation in gloss in the image. The reduction in temperature is most noticeable as the roller 44 completes one revolution. It shows up as an abrupt reduction in gloss which is quite noticeable.

This problem is alleviated by utilizing the two speed drive embodied in motor 42 to drive the fusing rollers 44 and 45 at a first speed for the first revolution of the fusing roller contacting the image, first roller 44. As the first roller 44 completes its first revolution after entry of the receiving sheet into the nip, the speed of the fuser is abruptly reduced to compensate for the now cooled portion of the fusing roller beginning to contact the toner image. The reduction in speed greatly increases the heat applied to the toner which compensates for the cooling of the surface by the first rotation in contact with the thick receiving sheet.

Timing can be accomplished in a number of ways. For example, a sensor 50 can be positioned a distance downstream of the nip equal to the circumference of first fusing roller 44. Actuation of the sensor 50 causes an immediate reduction in the speed of the motor 42. The reduction in speed could also be controlled in response to the abrupt reduction in temperature combined with knowledge of the rotation of roller 44. A preferred timing approach is to utilize a sensor 52 already in the nip to provide jam detection. The speed is then reduced a predetermined time after actuation of sensor 52. The time is, of course, dependent on the first speed and the circumference of roller 44.

If more than two revolutions of first fusing roller 44 are necessary to complete the fixing of the receiving sheet, the speed can again be reduced as the first fusing roller begins its third revolution. However, some compensation for the cooling of the surface by an increase in power to heating elements 48 and 49 takes effect by this time and such a further reduction in speed is not always necessary. In the preferred embodiment of the apparatus shown in FIG. 1, the receiving sheet is a ledger size sheet of 60 pound bond paper (225 grams per square meter), for example, 11×17 inches, with the intrack length being 17 inches. A 7½ inch circumference first fusing roller 44 would complete its second revolution two inches from the trailing edge of the sheet. Margins are provided at both the leading and trailing edges which in most instances is at least an inch at the trailing edge. We have found that it is not necessary with this apparatus to provide the second reduction in speed for consistent high quality images.

The speed of the fuser (both fast and slow) can be adjusted according to the weight of the paper. For example, the sensing device 56 can again be used to slow the fuser when going between regular 20 pound bond paper and 60 pound bond paper.

In using image forming apparatus 1 for making greeting cards, it is assumed that the copy after appropriate trimming will be folded. For example, it may be folded in the center, making a four page card which would commonly have greetings, messages and pictures on the first three pages. With the use of photos and other extensive broad coloring for such cards, it is common that one of the pages will have a substantially more dense image than the page adjacent it on the other side of the fold. It is desirable that the more dense portion of the image receive the most reliable heavy fusing to provide the gloss desired for it, as well as to make sure that toner stacks are fully fused. Reliability in this respect can be assisted by feeding the sheet into the fuser with the most dense portion leading. The most dense portion of the image then is less affected by the cooling of the fusing rollers from contact with the sheet. Such image orientation can be accomplished by rotating both images electronically or by hand at the composing stage.

In duplex copying with a receiving sheet path such as that shown in FIG. 1, a receiving sheet must pass through the fuser 40 twice. The first toner image passes through the fuser twice while the second toner image only passes through once. It is generally known to reduce the amount of heat used in the first passage, for example, by speeding up the fuser, to a minimum amount to allow the sheet to be handled without smearing of the image. The heat is then increased for the second pass to finish the fusing of the first image and complete the entire fusing of the second image.

This approach of applying less heat to the receiving sheet the first time through the fuser is usable in many applications. Its use will depend on the difficulty of smearing the image and the effect on the paper of having it pass through the fuser twice at the regular speed. It is not desirable in all applications, for example, it may not be desirable with color images because of the difficulty preventing smearing of substantial stack heights in color toner images.

In either case, the first image will receive more heat in its two passes through the fuser than will the second image. Assuming that the texture of the surfaces of the rollers 44 and 45 are comparable, the first image will have a higher gloss than the second image.

This aspect of the FIG. 1 apparatus can be managed and even taken advantage of in forming the images. In many applications, it is more important for one image to be glossy than another. Although this concept is not limited to greeting cards, greetings cards are a particularly good example. Particularly sophisticated customized greeting cards may use more than one photo. Similarly, customization is also useful when no photos are being used. However, a very common and attractive utilization of customization in greeting cards involves the combination of a single photo with other greeting card graphics, including a customized message, a background and perhaps other decoration or drawings. In this last and very common situation, it is usually quite desirable to do the image containing the photo with as high a gloss as possible. The other image may be indifferent to gloss or even prefer a more matte finish. Thus, with the image forming apparatus shown in FIG. 1 in which one toner image receives more fusing heat than does the other toner image, it is important to choose which image to form first.

In its most basic sense, this feature can be utilized in an image forming apparatus that does not have a duplex path such as path 60 but in which duplex images are made by hand refeeding of the receiving sheet. In this case, the operator is given instructions to choose the image the operator prefers to be most glossy to form first. Then, the receiving sheet is removed from output tray 64 and placed in the top of paper supply 15 with the first image up. The receiving sheet then passes through the system again receiving the second image on the second side (downside in the paper supply) and the first image receives a second fusing that improves its gloss when it passes through the fuser.

The operator can be assisted in this process by an operator control panel (OCP) 90. For example, present operator control panels include display screens which will step-by-step lead an operator through a complex process with a copier or printer. If the operator decides to do duplex color with image forming apparatus 1, that information is input through OCP 90. OCP 90 then instructs the operator to compose first the image to have the highest gloss. After that image has been formed and fused, the operator is instructed to remove it from the output hopper 64 and place it first imageside faceup in paper supply 15 for copying a second side which the operator is advised is the "more matte" side. This basic instruction can be modified in many ways. For example, instead of suggesting that the glossy side be done first, the operator can be instructed to do the side with the photographic image first. The detail of the instruction would clearly depend on the expected sophistication of the operator.

FIG. 1 illustrates several alternative approaches to electronic image formation, each of which can be adapted to the other features of the apparatus. In its most basic form, the front end electronics are essentially the same as that on the Kodak ColorEdge 1550 Plus color copier, referred to above, and on other available commercial image forming apparatus. In this basic apparatus, the image is composed by hand for a color scanner 95, the output of which is used with minimal electronic manipulation to control laser 6 in image formation. A greeting card with a combination of photo, message and other graphics can be made on such apparatus by cutting and pasting with one side being input through color scanner 95 in a single operation. The prompting from OCP 90 mentioned above is appropriate to such an apparatus.

A more sophisticated approach is also shown in FIG. 1 using a workstation 74 and page composition electronics 72 for composing each multicolor image for feeding to laser control electronics 70. In this instance, the image combining techniques disclosed in the above U.S. Pat. No. 5,459,819 to Watkins et al are particularly usable to form images that combine messages, other graphics and photographic images into a single multicolor image. Again, suitable prompts to the operator at the workstation 74 suggesting that the image that is preferably most glossy be formed first, will assure the desired result with that image passing through fuser 40 twice. A preferred approach to such prompts would give the operator a choice between a glossy or a matte finish for the sides in question. One aspect of customization is to provide the customer with what he desires. In this instance, the customer may prefer to have the photographic image more matte and the other image more glossy. In such a case, the photographic side would be made last.

The choice may also be made automatically or by default. In this embodiment, the page composition electronics necessarily contains information associated with the makeup of each of both images. If only one of the images contains information from color scanner 95, that fact is necessarily known to page composition electronics 72. Page composition electronics 72 can then feed that page to laser control electronics 70 first. Other priorities can also be used. If both images contain material from color scanner 95, page composition electronics can be programmed to determine which material from color scanner 95 makes up the largest portion of its image.

Another preference useful in some situations is to determine which image has the most large areas of a single color without detail. The extra fusing in making the first image glossy helps hide any grain shown in such areas. Thus, image analysis for such a characteristic is used to determine which image should be formed first. Sophisticated electronics is also available and can analyze a color image and distinguish the portion which has a photographic origin from the portion which is text or other graphics. Such image analysis could be used, not only in the more sophisticated approach using workstation 74 and page composition electronics 72, but also in the more basic approach in which the output of color scanner 95 is fed directly to laser control electronics and page composition is accomplished by cut and paste.

The invention has been described in detail with particular reference to a preferred embodiment thereof, but it will be understood that variations and modifications can be effected within the spirit and scope of the invention as described hereinabove and as defined in the appended claims.

We claim:

1. A method of forming duplex color images which includes the steps of:

forming a first toner image on a first side of a receiving sheet, then passing the receiving sheet through a fuser, then forming a second toner image on a second side of the receiving sheet, then passing the receiving sheet again through a fuser, the improvement comprising determining which image to be formed should have a greater gloss and forming that image as the first image on the first side of the receiving sheet.

2. The method according to claim 1 wherein the determining step includes the step of determining which image will have more photographic content.

3. The method according to claim 1 wherein the step of forming includes scanning an original to provide at least a portion of one of the images and wherein the step of determining is accomplished by determining which toner image includes a portion from the scanned image.

4. The method according to claim 1 wherein said steps of forming the first and second toner images each include forming a plurality of single color toner images and combining the single color toner images on the receiving sheet so that both the first and second toner images are multicolor images.

5. The method according to claim 4 wherein both the first and second images include material combined from different sources and an available source is a color scanner and wherein the determining step is accomplished by determining which toner image includes more material from the color scanner.

6. The method according to claim 1 wherein both the first and second images are produced entirely from scanned information and the determining step includes analyzing the scanned information for content.

7. The method according to claim 6 wherein the analyzing step included determining the image with more photographic content.

8. The method according to claim 1 further including prompting an operator to control image formation according to desired relative glossiness of the first and second images.

9. The method according to claim 8 wherein said prompting step includes indicating to the operator that the operator should determine which image has more photographic content.

10. In a method of forming a fixed toner image on a receiving sheet, which method includes forming an unfixed toner image on a receiving sheet and feeding the receiving sheet into a fusing nip formed by heated pressure members which have a tendency to cool in response to contact with the receiving sheet in the nip, the improvement comprising determining which intrack end of the receiving sheet will contain a greater density in the toner image and positioning the image on the receiving sheet so that the receiving sheet is fed into the fusing nip with the intrack end of the receiving sheet with the image with the greater density entering the fusing nip first.

11. The improvement according to claim 10 wherein the positioning step is accomplished electronically.

* * * * *